United States Patent [19]

Johanson

[11] Patent Number: 4,958,741

[45] Date of Patent: Sep. 25, 1990

[54] MODULAR MASS-FLOW BIN

[75] Inventor: Jerry R. Johanson, San Luis Obispo, Calif.

[73] Assignee: Jr Johanson, Inc., San Luis Obispo, Calif.

[21] Appl. No.: 365,916

[22] Filed: Jun. 14, 1989

[51] Int. Cl.[5] ..... B65D 25/14

[52] U.S. Cl. ..... 220/83; 220/DIG. 13; 220/1 R

[58] Field of Search ..... 220/83, DIG. 13, 1 R

[56] References Cited

U.S. PATENT DOCUMENTS

| | | | |
|---|---|---|---|
| 908,579 | 1/1909 | Knobloch | 220/83 |
| 1,331,372 | 2/1920 | Popper | 220/DIG. 13 |
| 1,701,313 | 2/1929 | Sherman | 220/83 |
| 3,565,280 | 2/1971 | Rausing | 220/83 |
| 4,057,163 | 11/1977 | Widart et al. | 220/83 |
| 4,452,381 | 6/1984 | Freeman | 220/DIG. 13 |

*Primary Examiner*—Joseph Man-Fu Moy

*Attorney, Agent, or Firm*—Daniel C. McKown

[57] ABSTRACT

A bin adapted for storing and dispensing particulate materials is formed by joining two or more bin modules of similar shape. The linear dimensions of the modules increase in a geometric series, with the smallest module being at the bottom. The modules are designed to prevent arching of the particular material to assure mass flow. Three embodiments of bin modules are described. In the first and the third embodiments, each module consists of two sections, but in a second embodiment the module consists of four sections. A bin constructed of these modules requires appreciably less head room than does a conical bin.

21 Claims, 4 Drawing Sheets

MODULAR MASS-FLOW BIN

BACKGROUND OF THE INVENTION

1. Field of the Invention

The present invention is in the field of storage bins for solid particulate materials, such as grain. More particularly, there is described a bin that includes a number of modules of similar shape but increasing size which are connected in a sequence. The resulting bin will exhibit mass flow with less vertical headroom required than in existing designs, especially when friction angles are high.

2. The Prior Art

Several considerations drive the design of hoppers. First, it is important that the material not form a bridge or arch within the hopper, because an arch interferes with or terminates the flow of material from the bottom of the hopper. If and when the arch collapses, the material may surge from the hopper. It is well known that arcing can be eliminated if the opening at the bottom of the hopper is large enough. For a right circular conical hopper, the critical gravity flow arching dimension for a particular material is designated as $B_c$. As will be seen below, some embodiments of the present invention permit the use of discharge openings that are only a fraction of $B_c$.

A second consideration in the design of hoppers is that the wall of the hopper must be steep enough so that the material will slide smoothly along the wall during discharge. If the wall is not steep enough, a thick layer of the material will cling to the wall and discharge will take place from only a limited region near the axis of the hopper, a condition referred to as "rat-holing." For a hopper having the shape of a section of a right circular cone, the largest semi-apex angle at which mass flow will occur, for a particular material, is denoted by $\theta_c$, the mass flow angle for that particular material. As will be seen below, the present invention permits the use of semi-apex angles that are appreciably greater than $\theta_c$.

A further consideration in the design of hoppers is the optimization of the geometry of the hopper within the constraints described above. Normally, in most applications one would prefer, for a given volume, the hopper which is shortest in height. From elementary geometry it is known that the volume within a truncated right circular cone is given by the relation $$V = \frac{\pi H}{12}\left[(d + 2H\tan\theta)^2 + d(d + 2H\tan\theta) + d^2\right]$$

where d is the diameter of the smaller end, where H is the height, and where $\theta$ is the semi-apex angle of the truncated cone. The dependence of the volume on the semi-apex angle $\theta$ is very strong. For example, for a typical hopper with d=1 and H=5 the volume will increase by a factor of 1.97 as the angle $\theta$ increases from 20 degrees to 30 degrees. This effect is even more pronounced for smaller values of $\theta$ such as would be required for materials that are more cohesive. For example, for the same typical hopper, the volume increases by a factor of 2.38 as the semi-apex angle $\theta$ increases from 10 degrees to 20 degrees. As will be seen below, the present invention permits the use of semi-apex angles appreciably greater than $\theta_c$, and for a given volume this results in a bin having considerably less height.

Although conical, rectangular and chisel-shaped hoppers are known in the art, hoppers having the unique shape described herein are believed to be new and advantageous.

The following technical articles by the present inventor show the state of the art: "Design for Flexibility in Storage and Reclaim," Chemical Engineering, Oct. 30, 1978, pp. 19–26; "Selection and Application Factors for Storage Bins for Bulk Solids," Plant Engineering, July 8, 1976; Stress and Velocity Fields in the Gravity Flow of Bulk Solids, Journal of Applied Mechanics, 1964, Series E 31 pp. 499–506; "Feeding," Chemical Engineering, Oct. 13, 1969, pp. 75–83 "Method of Calculating Rate of Discharge from Hoppers and Bins," Transactions of SME, Mar. 1965, Vol. 232, pp. 69–80; and "New Design Criteria for Hoppers and Bins," Iron and Steel Engineer, Oct. 1964, pp. 85–104 (with Colijn, H.).

SUMMARY OF THE INVENTION

The present invention includes a novel hopper design that causes mass flow in converging hoppers with less vertical headroom than in existing designs, especially when friction angles are high. Three embodiments of the present invention are described below.

The first and preferred embodiment, shown in FIGS. 1–4, provides flow through a circular outlet of diameter equal to one-half $B_c$ or greater.

The second embodiment, shown in FIGS. 5–8 provides flow through circular outlets of diameter less than one-half $B_c$, but requires additional vertical sections to do so.

The third embodiment, shown in FIGS. 9–12 requires a circular outlet of diameter $B_c$ or greater, but it minimizes the headroom required.

As will be described below, each of the three embodiments is characterized by its own elemental module. Bins of any desired size can be formed by assembling a number of similar elemental hoppers all having the same shape but progressively increasing sizes, so that the bottom of each successive module fits the top of the module below it.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 13:
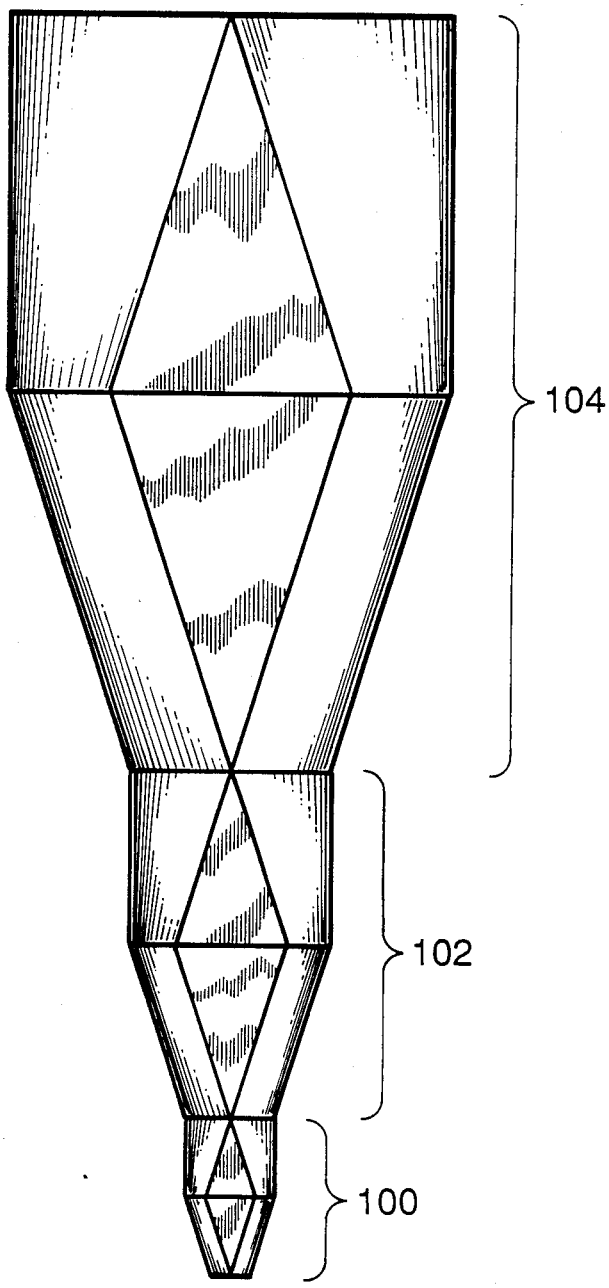
FIG. 13 is a front elevational view of a bin formed of bin modules of the first preferred embodiment of the present invention; and, FIG. 14 is a side elevational view of the bin of FIG. 13.
Figure 14:
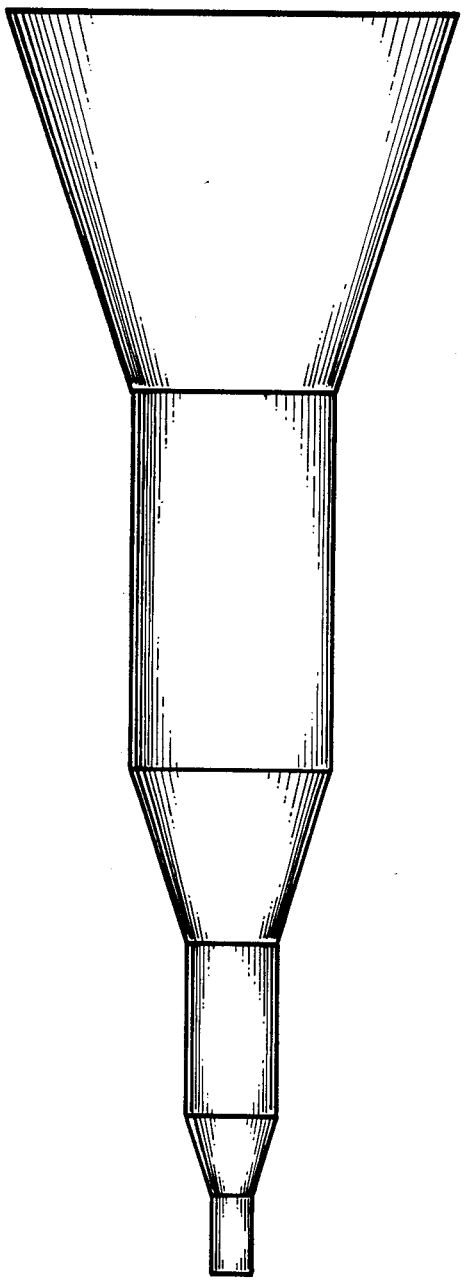

A first and preferred embodiment of the bin module of the present invention is shown in FIGS. 1–4. As will be described below, this module can be repeated on a progressively increasing scale to provide a bin of the type shown in FIGS. 13 and 14. Once the module of FIGS. 1–4 has been specified in detail, the structure of the entire bin of FIGS. 13 and 14 is established.

Bins of the type described herein are ordinarily fabricated of sheetmetal, typically galvanized steel, although the present invention is not limited to any particular material. In some cases, the choice of material is determined by the chemical nature of the particulate material to be stored, and may also depend on the physical dimensions of the bin.

Turning now to FIGS. 1–4, in the first and preferred embodiment, the bin module includes a first section 10 and a second section 28. The first section includes a circular lower edge 12 from which the section extends upwardly to an oval-shaped upper edge 14. This first section 10 may be used individually as a complete bin.

Figure 3:
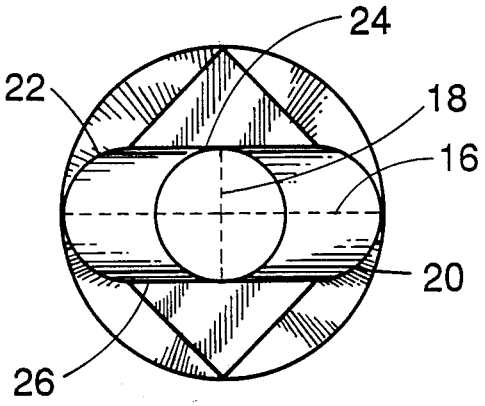
FIG. 3 is a top plan view of the embodiment of FIG. 1.
Figure 4:
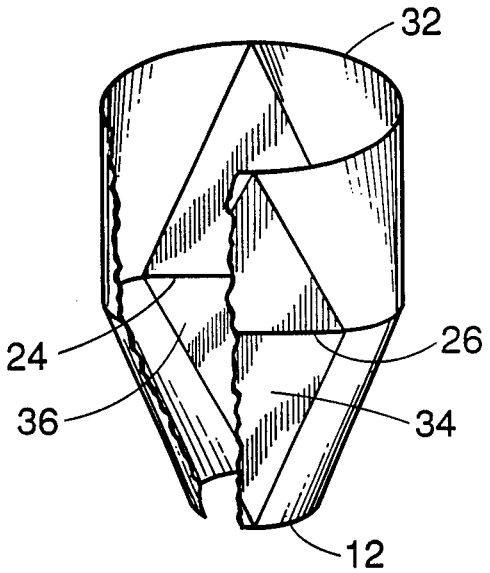
FIG. 4 is a perspective view, partially cut away, of the embodiment of FIG. 1.
Figure 1:
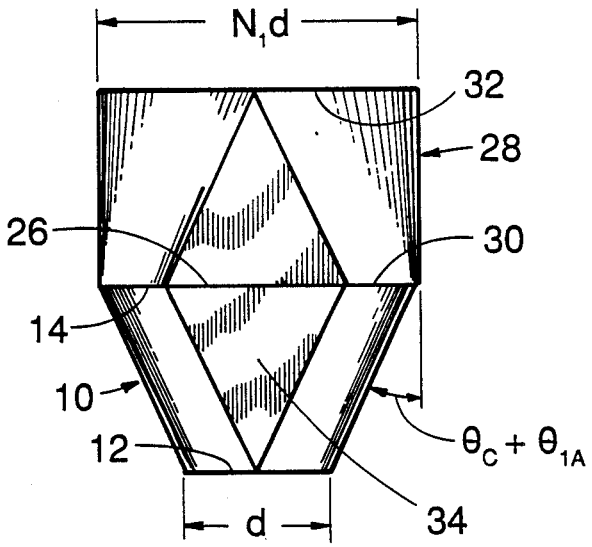
FIG. 1 is a front elevational view of a bin module in accordance with a first and preferred embodiment of the present invention.

As applied to the bin modules described herein, the term oval-shaped includes, without limitation, the race track shaped figure visible in FIG. 3 as well as true ellipses. In the race track configuration shown in FIG. 3, the oval-shaped upper edge 14 includes the spaced semicircular portions 20 and 22 which are connected by the straight line portions 24 and 26. The oval-shaped edges are symmetric with respect to a major axis 16 and are also symmetric with respect to a minor axis 18. The length of the major axis 16 equals $N_1d$ where d is the diameter of the circular lower edge 12 of the first section 10. The length of the minor axis 18 equals d in the preferred embodiment and in any case should not exceed d. In alternative embodiments, the length of the minor axis 18 is very slightly less than d.

Experience has shown that the front and rear triangular portions, 34 and 36 respectively, must be vertical or must diverge downwardly a few degrees if the arch reduction capability of the module is to be obtained.

Unlike a right circular cone wherein the semi-apex angle of the cone must not exceed $\theta_c$ in order for mass flow to occur, in the embodiment shown in FIGS. 1–4, the sides of the first section 10 may converge with respect to the vertical by an additional angle $\theta_{1A}$, where $\theta_{1A}$ is an angle between 10 degrees and 20 degrees.

Figure 2:
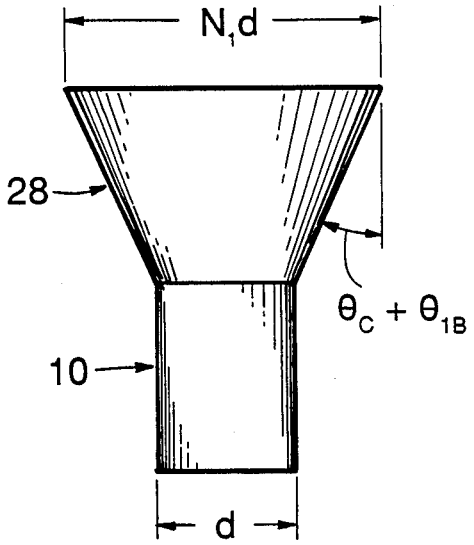
FIG. 2 is a side elevational view of the embodiment of FIG. 1.
Figure 7:
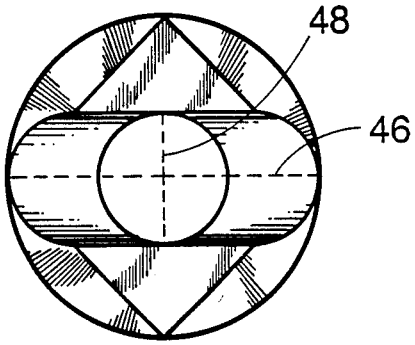
FIG. 7 is a top plan view of the embodiment of FIG. 5.
Figure 8:
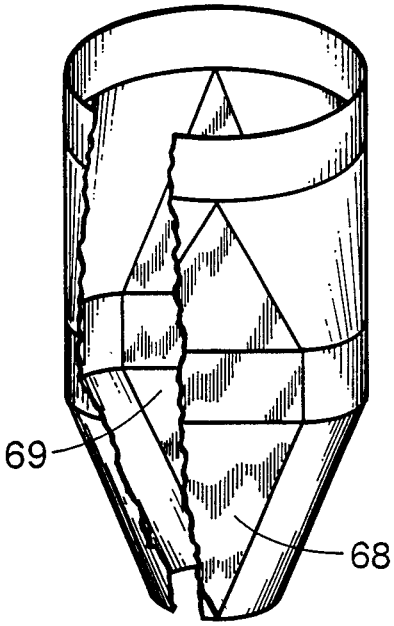
FIG. 8 is a perspective view, partially cut away, of the embodiment of FIG. 5.

The second section 28 extends upwardly from an oval-shaped lower edge 30 to a circular upper edge 32. The oval-shaped lower edge 30 of the second section 28 is the same size and shape as the oval-shaped upper edge 14 of the first section. Ordinarily, these two edges are joined by welding or by fasteners. As shown in FIG. 2, the front and rear of the second section 28 converge with respect to the vertical by an angle $\theta_c+\theta_{1B}$, where $\theta_{1B}$ is an angle between 10 degrees and 20 degrees. In a special case, $\theta_{1A}=\theta_{1B}=\theta_1$.

In accordance with the preferred embodiment of the present invention, the diameter of the circular upper edge 32 of the second section is equal to $N_1$ times the diameter of the circular lower edge 12 of the first section 10. Thus, the linear dimensions of a second module, to be added to the top of the module shown in FIGS. 1–4 are scaled up by a factor of $N_1$ relative to the first module. In the preferred embodiment, $N_1$ is any number between 1.0 and 3.0.

So long as the front and rear triangular portions 34, 36 are vertical or slightly diverging downwardly, the diameter d of the circular lower edge 12 of the first portion 10 may be as small as 0.5 $B_c$; here $B_c$ is the critical arching dimension for a right circular cone. Thus, compared to a right circular cone, arching is much less likely to occur in a hopper of the present invention having the same diameter outlet.

Because the basic module shown in FIGS. 1–4 has circular lower and upper edges, and because it provides for mass flow, a second module may be joined to the top of a first module at any degree of rotation about the vertical axis.

FIGS. 5–8 show a second embodiment of the present invention. Structurally, it differs from the embodiment of FIGS. 1–4 in the addition of an oval-shaped second section 50 of vertical height $h_1$, and in the addition of a circular fourth section 62 of vertical height $h_2$.

As shown in FIGS. 5-8, this second embodiment includes a first section 40 which extends from a circular lower edge 42 to an oval-shaped upper edge 44. The oval-shaped upper edge has a major axis 46 and a minor axis 48, and the first section of this embodiment is similar to the first section 10 of the first embodiment.

A second section 50 is joined to the first section 40. The second section 50 extends from an oval-shaped lower edge 52 to an oval-shaped upper edge 54. The wall of the second section is substantially vertical.

The first and second sections 40 and 50 together can be used as a complete bin.

A third section 56 is joined to the top of the second section 50. The third section 56 includes an oval-shaped lower edge 58 and a circular upper edge 60. This third section is similar to the second section 28 of the embodiment of FIGS. 1–4.

Finally, a fourth section 62 is attached to the top of the third section 56. The fourth section 62 includes a circular lower edge 64 and a circular upper edge 66. The wall of the fourth section is substantially vertical.

Figure 5:
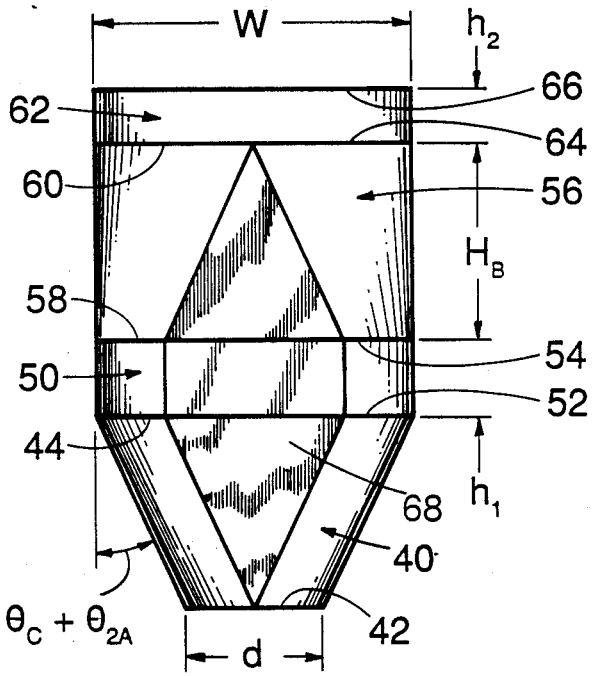
FIG. 5 is a front elevational view of a second embodiment of a bin module in accordance with the present invention.
Figure 6:
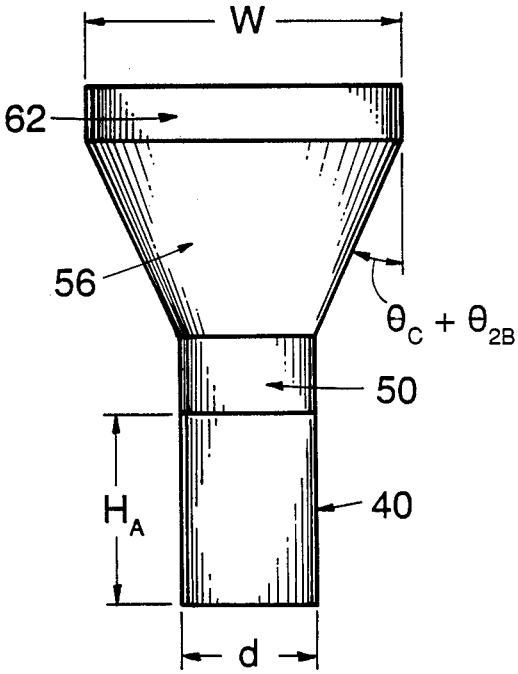
FIG. 6 is a side elevational view of the embodiment of FIG. 5.
Figure 11:
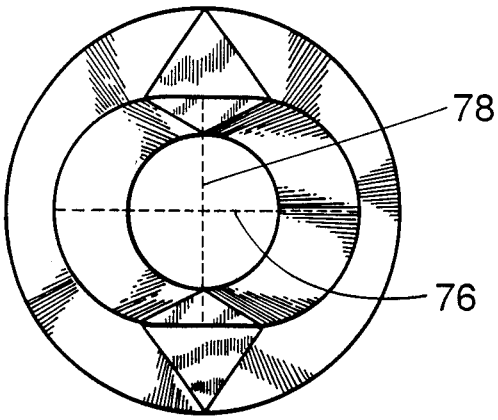
FIG. 11 is a top plan view of the embodiment of FIG. 9.
Figure 12:
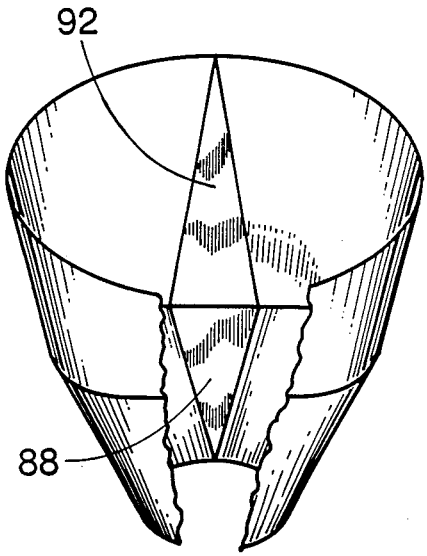
FIG. 12 is a perspective view, partially cut away, of the embodiment of FIG. 9.
Figure 9:
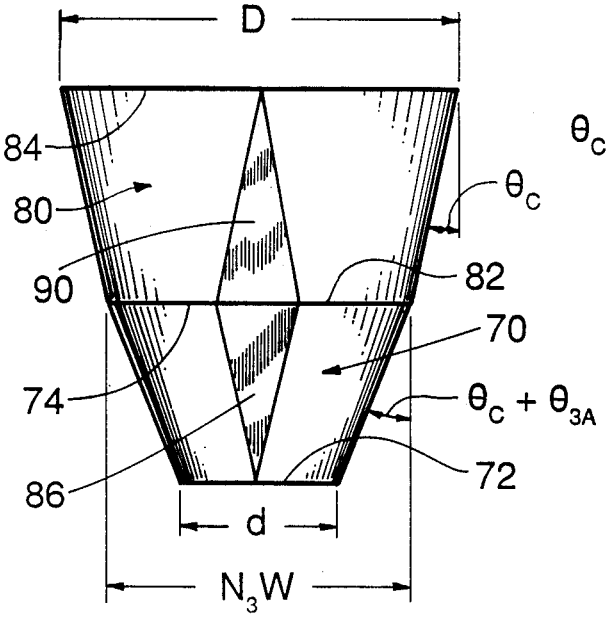
FIG. 9 is a front elevational view of a third embodiment of a bin module in accordance with the present invention.
Figure 10:
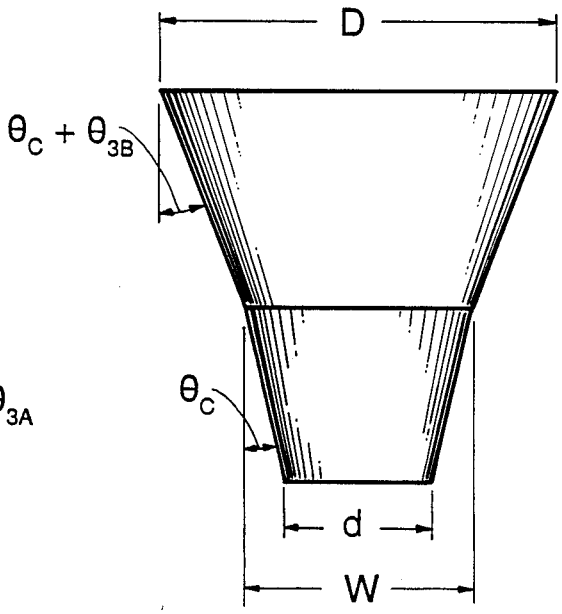
FIG. 10 is a side elevational view of the embodiment of FIG. 9.

As shown in FIGS. 5 and 6, the sides of the first section 40 converge with respect to the vertical by an angle $\theta_c+\theta_{2A}$, where $\theta_{2A}$ is an angle between 10 degrees and 20 degrees. Also, the front and back of the third section 56 converge with respect to the vertical by an angle $\theta_c+\theta_{2B}$ where $\theta_{2B}$ is an angle between 10 degrees and 20 degrees. In a special case, $\theta_{2A}=\theta_{2B}=\theta_2$.

The additional vertical sections 50 and 62 give this second embodiment shown in FIGS. 5–8 greater arch-breaking capability than the embodiment of FIGS. 1–4. That is, the minimum diameter of the circular lower edge 42 can be even less than $B_c/2$. In fact, it can be shown that arches will not form so long as d exceeds $B_c/2F$ where F is an arch reduction factor equal to $1+h_1/H_A$, where $H_A$ is the height of the first section 40. Similarly, arches above the edge 54 will not form as long as $h_2$ is selected such that $$h_2 \geqq H_B\left[\frac{B_c}{2d} - 1\right]$$

where $H_B$ is the height of the third section 56.

It can also be shown that the diameter W of the circular upper edge 66 must be related to the vertical heights $H_A$ and $H_B$ of each section by the relationships $$H_A < \frac{W}{3}\cos(\theta_c + \theta_{2A})$$

$$H_B < \frac{W}{3}\cos(\theta_c + \theta_{2B})$$

As in the embodiment of FIGS. 1–4, the front triangular portion 68 and the rear triangular portion 69 must be vertical or even slightly diverging downwardly if the maximum arch breaking capability is to be attained.

FIGS. 9–12 show a third embodiment of the present invention. Although this embodiment requires a circular outlet of diameter d equal to $B_c$ or greater, its design produces a great reduction in head room relative to a right circular cone.

The bin module of FIGS. 9–12 includes a first section 70 and a second section 80. The first section 70 extends upward from a circular lower edge 72 of diameter d to an oval-shaped upper edge 74 having a major axis equal to $N_3W$ and a minor axis 78 equal to W. The second section 80 includes an oval-shaped lower edge 82 that is joined to the oval-shaped upper edge 74 of the first section 70 and extends upward to a circular upper edge 84 of diameter D. The first section 70 can be used by itself as a complete bin.

Unlike the first embodiment of FIGS. 1–4, the front and rear triangular portions 86 and 88 respectively converge downwardly making an angle no greater than $\theta_c$ with respect to the vertical. The sides of the first section 70 converge downwardly making an angle of $\theta_c$ plus $\theta_{3A}$ with respect to the vertical, where $\theta_{3A}$ is an angle between 5 degrees and 15 degrees. Likewise, the front and rear triangular portions 90 and 92 respectively of the second section 80 converge downwardly making an angle of $\theta_c$ plus $\theta_{3B}$ with respect to the vertical, where $\theta_{3B}$ is an angle between 5 and 15 degrees. The sides of the second section converge downwardly at an angle $\theta_c$ with respect to the vertical.

To prevent the formation of arches, the dimension d should be greater than the critical arching dimension $B_c$. To cause mass flow $N_3$ must be $\leqq 2.5$. The geometry of the hopper is such that $$W = \frac{\left(1 - \frac{\tan\theta_c}{\tan(\theta_c + \theta_{3A})}\right)}{\left(1 - \frac{N_3\tan\theta_c}{\tan(\theta_c + \theta_{3A})}\right)} d$$

and,

-continued $$D = W\frac{\left(1 - \frac{N_3\tan(\theta_c + \theta_{3B})}{\tan\theta_c}\right)}{\left(1 - \frac{\tan(\theta_c + \theta_{3B})}{\tan\theta_c}\right)}$$

In the embodiment of FIGS. 9–12, as in the embodiment of FIGS. 1–4, the heights of the first and second sections are equal whenever $\theta_{3A}=\theta_{3B}=\theta_3$.

FIGS. 13 and 14 are, respectively, a front view and a side view of a bin formed by joining three bin modules of the type shown in FIGS. 1–4. The three modules 100, 102, and 104 share a common vertical axis. The linear dimensions of the modules are in the ratio $1:N_1:N_1^2$.

Thus, there have been described three embodiments of a bin module which requires less head room than a right circular cone, and which has superior arch-breaking capabilities. Minor variations on these embodiments will be apparent to practitioners in this field, and such variations are considered to be within the scope and spirit of the present invention.

What is claimed is:

1. A bin module comprising:

a first section that extends upwardly from a circular lower edge of diameter d to an oval-shaped upper edge, the major axis of the oval-shaped upper edge exceeding the diameter of the circular lower edge;

a second section that extends upwardly from an oval-shaped lower edge that is attached to the upper edge of said first section to an oval-shaped upper edge, the major and minor axes of the upper edge not exceeding the major and minor axes of the lower edge, the vertical height of said second section being $h_1$;

a third section that extends upwardly from an oval-shaped lower edge that is attached to the upper edge of said second section to a circular upper edge, the diameter of the circular upper edge exceeding the minor axis of the oval-shaped lower edge; and, a fourth section that extends upwardly from a circular lower edge that is attached to the upper edge of said third section to a circular upper edge the diameter of which does not exceed the diameter of the lower edge, the vertical height of said fourth section being $h_2$.

2. The bin module of claim 1 wherein $h_1=0$ and $h_2=0$, wherein the minor axis of the oval-shaped upper edge of said first section exceeds the diameter of the circular lower edge of said first section.

3. The bin module of claim 2 wherein $d \geqq B_c$, where $B_c$ is the critical gravity flow arching dimension for a right circular conical hopper.

4. The bin module of claim 2 wherein the sides of said first section converge downwardly at an angle of $\theta_c + \theta_{3A}$ with respect to the vertical, wherein the front and rear of said third section converge downwardly at an angle of $\theta_c+\theta_{3B}$ with respect to the vertical, wherein the minor axis of the upper edge of said first section is substantially equal to W , the major axis of the upper edge of said first section is substantially equal to $N_3W$ and the diameter of the upper edge of said third section is equal to D , where $\theta_c$ is the mass flow angle for a right circular cone, and where $$5° < \theta_{3A} < 15° \qquad 5° < \theta_{3B} < 15°$$

$$N_3 < 2.5$$

$$W = d\frac{\left(1 - \frac{\tan\theta_c}{\tan(\theta_c + \theta_{3A})}\right)}{\left(1 - \frac{N_3 \tan\theta_c}{\tan(\theta_c + \theta_{3A})}\right)}$$

and $$D = W\frac{\left(1 - \frac{N_3 \tan(\theta_c + \theta_{3B})}{\tan\theta_c}\right)}{\left(1 - \frac{\tan(\theta_c + \theta_{3B})}{\tan\theta_c}\right)}$$

5. The bin module of claim 4 wherein $\theta_{3A}=\theta_{3B}$.

6. The bin module of claim 1 wherein the minor axis of the oval-shaped upper edge of said first section does not exceed the diameter of the circular lower edge of said first section.

7. The bin module of claim 6 wherein $h_1=0$, $h_2=0$ and wherein $\alpha \leqq B_c/2$ where $B_c$ is the critical gravity flow arching dimension for a right circular conical hopper.

8. The bin module of claim 6 wherein $h_1=0$ and $h_2=0$ and wherein the sides of said first section converge downwardly at an angle of $\theta_c+\theta_{1A}$ with respect to the vertical, wherein the front and back of said third section converge downwardly at an angle of $\theta_c+\theta_{1B}$ with respect to the vertical, and wherein the diameter of the circular upper edge of said third section is equal to $N_1$ times the diameter d of the circular lower edge of said first section, where $$10° < \theta_{1A} < 20°$$

$$10° < \theta_{1B} < 20°$$

$$1.0 < N_1 < 3.0$$

and where $\theta_c$ is the mass flow angle for a right circular cone.

9. The bin module of claim 8 wherein $\theta_{1A}=\theta_{1B}$.

10. The bin module of claim 6 wherein $$d > \frac{B_c}{2\left(1 + \frac{h_1}{H_A}\right)}$$

where $H_A$ is the height of said first section and where $B_c$ is the critical gravity flow arching dimension for a right circular conical hopper.

11. The bin module of claim 6 wherein the sides of said first section converge downwardly at an angle of $\theta_c+\theta_{2A}$ with respect to the vertical, wherein the front and back of said third section converge downwardly at an angle of $\theta_c+\theta_{2B}$ with respect to the vertical , wherein the major axis of the oval-shaped upper edge of said first section is W , and the height of said third section is $H_B$, where $$10° < \theta_{2A} < 20° \qquad 10° < \theta_{2B} < 20°$$

-continued $$H_A < \frac{W}{3}\cos(\theta_c + \theta_{2A})$$

$$H_B < \frac{W}{3}\cos(\theta_c + \theta_{2B})$$

$$h_2 \geqq H_B\left(\frac{B_c}{2d} - 1\right)$$

and where $\theta_c$ is the mass flow angle for a right circular cone.

12. The bin module of claim 11 wherein $\theta_{2A}=\theta_{2B}$.

13. A bin module comprising:

a first section that extends upwardly from a circular lower edge of diameter d to an oval-shaped upper edge, the major axis of the oval-shaped upper edge exceeding the diameter of the circular lower edge, the minor axis of the oval-shaped upper edge not exceeding the diameter of the circular lower edge;

a second section that extends upwardly from an oval-shaped lower edge that is attached to the upper edge of said first section to an oval-shaped upper edge, the major and minor axes of the upper edge not exceeding the major and minor axes of the lower edge, the vertical height of said second section being $h_1$;

a third section that extends upwardly from an oval-shaped lower edge that is attached to the upper edge of said second section to a circular upper edge, the diameter of the circular upper edge exceeding the minor axis of the oval-shaped lower edge but not exceeding the major axis of the oval-shaped lower edge;

a fourth section that extends upwardly from a circular lower edge that is attached to the upper edge of said third section to a circular upper edge the diameter of which does not exceed the diameter of the lower edge, the vertical height of said fourth section being $h_2$; wherein $$d > \frac{B_c}{2\left(1 + \frac{h_1}{H_A}\right)}$$

where $H_A$ is the height of said first section and where $B_c$ is the critical gravity flow arching dimension for a right circular conical hopper.

14. A bin module comprising:

a first section that extends upwardly from a circular lower edge of diameter d to an oval-shaped upper edge, the major axis of the oval-shaped upper edge exceeding the diameter of the circular lower edge, the minor axis of the oval-shaped upper edge not exceeding the diameter of the circular lower edge;

a second section that extends upwardly from an oval-shaped lower edge that is attached to the upper edge of said first section to an oval-shaped upper edge, the major and minor axes of the upper edge not exceeding the major and minor axes of the lower edge, the vertical height of said second section being $h_1$;

a third section that extends upwardly from an oval-shaped lower edge that is attached to the upper edge of said second section to a circular upper edge, the diameter of the circular upper edge exceeding the minor axis of the oval-shaped lower edge but not exceeding the major axis of the oval-shaped lower edge;

a fourth section that extends upwardly from a circular lower edge that is attached to the upper edge of said third section to a circular upper edge the diameter of which does not exceed the diameter of the lower edge, the vertical height of said fourth section being $h_2$;

wherein the sides of said first section converge downwardly at an angle of $\theta_c+\theta_{2A}$ with respect to the vertical, wherein the front and back of said third section converge downwardly at an angle of $\theta_c+\theta_{2B}$ with respect to the vertical, wherein the major axis of the oval-shaped upper edge of said first section is W, and the height of said third section is $H_B$, where $$10^\circ < \theta_{2A} < 20^\circ \qquad 10^\circ < \theta_{2B} < 20^\circ$$

$$H_A < \frac{W}{3} \cos(\theta_c + \theta_{2A})$$

$$H_B < \frac{W}{3} \cos(\theta_c + \theta_{2B})$$

$$h_2 > H_B\left(\frac{B_c}{2d} - 1\right)$$

and where $\theta_c$ is the mass flow angle for a right circular cone.

15. The bin module of claim 14 wherein $\theta_{2A}=\theta_{2B}$.

16. A bin comprising a hollow shell including a circular lower edge, an oval-shaped upper edge, and having a wall that extends from said circular lower edge to said oval-shaped upper edge, wherein the oval-shaped upper edge defines a major axis and a minor axis, wherein the minor axis of the oval-shaped upper edge does not exceed the diameter d of the circular lower edge but the major axis of the oval-shaped upper edge does exceed the diameter d .

17. The bin of claim 16 wherein $$d \geqq \frac{B_c}{2},$$

where $B_c$ is the critical gravity flow arching dimension for a right circular conical hopper.

18. The bin of claim 16 wherein the wall slopes downward and inward from a point where the major axis intersects the oval-shaped upper edge at an angle equal to $\theta_c+\theta_{1A}$ with respect to the vertical, where $$10^\circ < \theta_{1A} < 20^\circ$$

and where $\theta_c$ is the mass flow angle for a right circular cone.

19. The bin of claim 16 further comprising a second section that extends vertically a height $h_1$ above the oval-shaped upper edge of said hollow shell.

20. The bin of claim 19 wherein $$d > \frac{B_c}{2\left(1 + \frac{h_1}{H_A}\right)}$$

where $H_A$ is the height of said hollow shell and $B_c$ is the critical gravity flow arching dimension for a right circular conical hopper.

21. The bin of claim 19 wherein the wall of said hollow shell slopes downward and inward from a point where the major axis intersects said oval-shaped upper edge at an angle of $\theta_c+\theta_{2A}$ with respect to the vertical, and wherein the major axis of said oval-shaped upper edge of said hollow shell is W, where $$10^\circ < \theta_{2A} < 20^\circ$$

and wherein $H_A$ is the height of said hollow shell, where $$H_A < \frac{W}{3} \cos(\theta_c + \theta_{2A})$$

and where $\theta_c$ is the mass flow angle for a right circular cone.

* * * * *